US009897314B2

(12) United States Patent
Bothien et al.

(10) Patent No.: US 9,897,314 B2
(45) Date of Patent: Feb. 20, 2018

(54) GAS TURBINE DAMPER WITH INNER NECK EXTENDING INTO SEPARATE CAVITIES

(71) Applicant: ALSTOM Technology Ltd, Baden (CH)

(72) Inventors: Mirko Ruben Bothien, Zürich (CH); Nicolas Noiray, Bern (CH); Bruno Schuermans, La Tour de Peilz (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 812 days.

(21) Appl. No.: 14/279,767

(22) Filed: May 16, 2014

(65) Prior Publication Data

US 2014/0345284 A1 Nov. 27, 2014

(30) Foreign Application Priority Data

May 24, 2013 (EP) ..... 13169241

(51) Int. Cl.
*F23R 3/00* (2006.01)
*F23M 20/00* (2014.01)

(52) U.S. Cl.
CPC ..... *F23M 20/005* (2015.01); *F23R 3/002* (2013.01); *F23R 2900/00014* (2013.01)

(58) Field of Classification Search
CPC .. F23R 2900/00013; F23R 2900/00014; F23R 2900/002; F23R 3/002;
(Continued)

(56) References Cited

U.S. PATENT DOCUMENTS 4,135,603 A * 1/1979 Dean, III ..... G10K 11/172 181/222
4,546,733 A * 10/1985 Fukami ..... F01N 1/006 123/184.57
(Continued)

FOREIGN PATENT DOCUMENTS

EP 1 568 869 8/2005
EP 2 397 760 12/2011
(Continued)

*Primary Examiner* — Pascal M Bui Pho
*Assistant Examiner* — Marc Amar
(74) *Attorney, Agent, or Firm* — Buchanan Ingersoll & Rooney PC

(57) ABSTRACT

The invention relates to a damper for reducing pulsations in a gas turbine, which includes an enclosure, a main neck extending from the enclosure, a spacer plate disposed in the enclosure to separate the enclosure into a first cavity and a second cavity and an inner neck with a first end and a second end, extending through the spacer plate to interconnect the first cavity and the second cavity. The first end of the inner neck remains in the first cavity and the second end remains in the second cavity. A flow deflecting member is disposed proximate the second end of the inner neck to deflect a flow passing through the inner neck. With the solution of the present invention, as a damper according to embodiments of the present invention operates, flow field hence damping characteristic in the second cavity constant regardless the adjustment of the spacer plate in the enclosure.

4 Claims, 4 Drawing Sheets

Fig.1

(58) Field of Classification Search
CPC ..... F05D 2260/96; F05D 2260/962; F05D 2260/963; F05D 2260/964; F02C 7/20
See application file for complete search history.

(56) References Cited

U.S. PATENT DOCUMENTS

| | | | | |
|---|---|---|---|---|
| 5,512,715 | A * | 4/1996 | Takewa | E04B 1/86 181/286 |
| 6,069,840 | A * | 5/2000 | Griffin | G10K 11/172 181/207 |
| 7,117,974 | B2 * | 10/2006 | Moenssen | F02M 35/1216 123/184.55 |
| 7,413,053 | B2 * | 8/2008 | Wasif | F23M 20/005 181/210 |
| 2005/0103018 | A1 | 5/2005 | Graf et al. | |
| 2005/0223707 | A1 * | 10/2005 | Ikeda | F23R 3/04 60/725 |
| 2011/0308630 | A1 * | 12/2011 | Huber | F23M 20/005 137/14 |
| 2011/0308654 | A1 * | 12/2011 | Bothien | F23M 99/005 138/31 |
| 2015/0059345 | A1 * | 3/2015 | Hellat | F23R 3/002 60/725 |

FOREIGN PATENT DOCUMENTS

| | | |
|---|---|---|
| EP | 2 642 204 | 9/2013 |
| JP | H04-089815 | 8/1992 |
| JP | 2006-029224 | 2/2006 |
| SU | 1695060 A1 | 11/1991 |

* cited by examiner

GAS TURBINE DAMPER WITH INNER NECK EXTENDING INTO SEPARATE CAVITIES

CROSS-REFERENCE TO RELATED APPLICATIONS

This application claims priority to European application 13169241.0 filed May 24, 2013, the contents of which are hereby incorporated in its entirety.

TECHNICAL FIELD

The present invention relates to gas turbine, in particular, to a damper for reducing the pulsations in the gas turbine.

BACKGROUND

In conventional gas turbines, acoustic oscillation usually occurs in the combustion chamber of the gas turbines during combustion process due to combustion instability and varieties. This acoustic oscillation may evolve into highly pronounced resonance. Such oscillation, which is also known as combustion chamber pulsations, can assume amplitudes and associated pressure fluctuations that subject the combustion chamber itself to severe mechanical loads that my decisively reduce the life of the combustion chamber and, in the worst case, may even lead to destruction of the combustion chamber.

Generally, a type of damper known as Helmholtz damper is utilized to damp the resonance generated in the combustion chamber of the gas turbine.

A damper arrangement is disclosed in EP2397760A1, which comprises a first damper connected in series to a second damper that is separated by a piston from the first damper, wherein the resonance frequency of the first damper is close to that of the second damper. A first neck interconnects the damping volumes of the first and second damper. A rod is connected to the piston to regulate the damping volumes of the first and second damper.

A damper is disclosed in US2005/0103018A1, which comprises a damping volume that is composed of a fixed damping volume and a variable damping volume. The fixed and variable damping volumes are separated by a piston, which may be displaced by means of an adjust element in the form of a thread rod. If the adjustment element is rotated, the piston moves along the cylinder axis of the damping volume and can adopt various positions. The frequency at which the damping occurs or reaches its maximum also changes correspondingly with the damping volumes.

One type of conventional Helmholtz damper features multiple damping volumes to provide a broadband damping efficiency. Individual volumes are interconnected with small plain tubes, i.e. so-called inner necks. Usually, the mean flow velocity in the inner neck is higher than that of the main neck connecting the damper to the combustion chamber. Especially for high-frequency dampers with small geometrical dimensions, the flow coming out of the inner necks either shoots into the main neck if the inner and main neck are placed coaxially or it impinges on an opposite structural components resulting in complicated flow fields. This can result in a dramatic decrease of damping efficiency. In addition, if the damper is tunable, the damper features a movable spacer plate or exchangeable necks to adjust the damper to the respective pulsation frequencies, where the damping characteristic is strongly dependent on the resulting flow fields. Position varieties of the spacer plate in the damper corresponds to different flow fields, which makes it not possible to set up the acoustic models to derive the damper design for a robust performance.

SUMMARY

It is an object of the present invention is to provide a damper for reducing pulsations in a gas turbine that may keep the flow field inside the damper stable and predictable, hence improve performance of tuneable dampers in the whole tuning range. Besides, the damper according to the present invention may provide for reliable layout and design, especially for small and high frequency dampers.

This object is obtained by a damper for reducing pulsations in a gas turbine, which comprises: an enclosure; a main neck extending from the enclosure; a spacer plate disposed in the enclosure to separate the enclosure into a first cavity and a second cavity, an inner neck with a first end and a second end, extending through the spacer plate to interconnect the first cavity and the second cavity, wherein the first end of the inner neck remain in the first cavity and the second end remain in the second cavity, characterized in that, a flow deflecting member is disposed proximate the second end of the inner neck to deflect a flow passing through the inner neck.

According to one possible, embodiment of the present invention, the flow deflecting member comprises at least one hole disposed on a peripheral surface of the inner neck proximate the second end thereof, and the second end of the inner neck is blinded or plugged.

According to one possible embodiment of the present invention, the at least one hole comprises at least two holes evenly disposed around the peripheral surface of the inner neck.

According to one possible embodiment of the present invention, the flow deflecting member comprises at least one guiding tube disposed proximate the second end of the inner neck, wherein an outlet of the guiding tube directs at a certain angle shifting from the longitudinal axis of the inner neck.

According to one possible embodiment of the present invention, the at least one guiding tube comprises at least two guiding tubes evenly disposed around the peripheral surface of the inner neck.

According to one possible embodiment of the present invention, the outlet of the guiding tube directs at the angle ranging from 0 to 90 degrees shifting from the longitudinal axis of the inner neck.

With the solution of the present invention, as a damper according to embodiments of the present invention operates, flow field hence damping characteristic in the second cavity constant regardless the adjustment of the spacer plate in the enclosure.

BRIEF DESCRIPTION OF THE DRAWINGS

The objects, advantages and other features of the present invention will become more apparent upon reading of the following non-restrictive description of preferred embodiments thereof, given for the purpose of exemplification only, with reference to the accompany drawing, through which similar reference numerals may be used to refer to similar elements, and in which.

DETAILED DESCRIPTION

Figure 1:
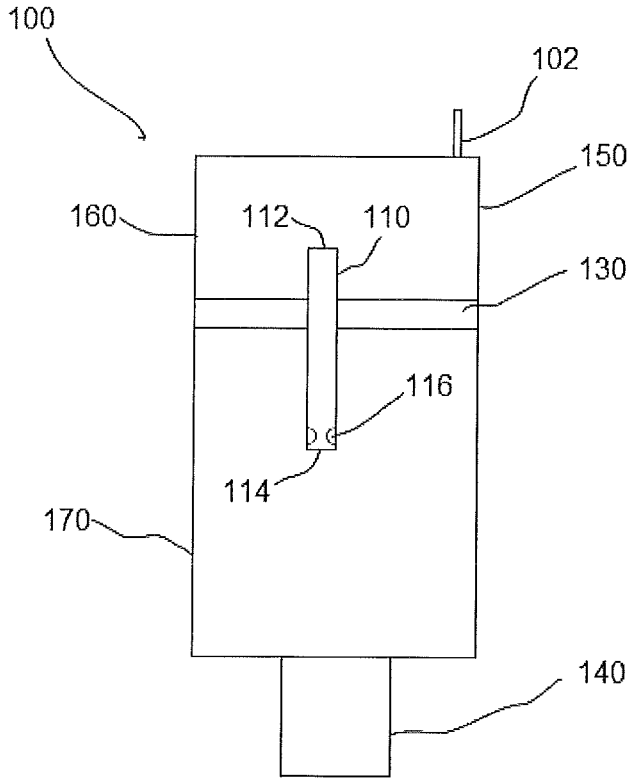
FIG. 1 shows an elevation side view of a damper according to one example embodiment of the present invention.

FIG. 1 shows an elevation side view of a damper 100 according to one example embodiment of the present invention. The damper 100 comprises an enclosure 150 with an inlet tube 102 to function as the resonator; a main neck 140 extending from the enclosure 150 for communicating the enclosure 150 and a combustion chamber of a gas turbine, not shown; a spacer plate 130 disposed in the enclosure 150 to separate the enclosure into a first cavity 160 and a second cavity 170; an inner neck 110 with a first end 112 and a second end 114, extending through the spacer plate 130 to interconnect the first cavity 160 and the second cavity 170, wherein the first end 112 of the inner neck 110 remains in the first cavity 160 and the second end 114 remains in the second cavity 170.

It should be noticed by those skilled in the art that the spacer plate 130 may be fixed in the enclosure 150, in which case the volume of the first cavity 160 and the second cavity 170 remain constant hence the resonant frequency they may reduce, or be movably disposed in the enclosure 150, in which case the volume of the first cavity 160 and the second cavity 170 may be adjusted by means of known method. The inlet tube 102 of the enclosure 150 communicates a plenum outside the enclosure 150 and the first cavity 160 in order to provide a flow path for a fluid entering and exiting the enclosure 150. Those skills in the art should understand that, the damper 100 may more than one main neck 140, and/or more than one inner neck 110, and/or more than two cavities 160, 170 in accordance with particular actual applications.

According to embodiments of the present invention, the damper 100 comprises a flow deflecting member disposed proximate the second end 114 of the inner neck 110 to deflect a fluid flow passing through the inner neck 110. It should be recognized by those skilled in the art that, as used herein, the term "proximate the second end" covers the meaning of "near the second end" and/or "at the second end". As shown in FIG. 1, the flow deflecting member may be embodied to be a hole 116 disposed on the peripheral surface of the inner neck 110 proximate the second end 114 thereof. In this case, the second end 114 of the inner neck 110 may be blinded or plugged in order to prevent fluid leakage therefrom. When the damper 100 is operated, the fluid coming through the inner neck 110 from the first end 112 thereof will exist therefrom by way of the hole 116 that directs sideway from the inner neck 110, which will keep the flow field hence damping characteristic in the second cavity 170 constant regardless the adjustment of the spacer plate 130 in the enclosure 150.

According to a preferable embodiment of the present invention, the flow deflecting member may comprises a plurality of holes 116 evenly spaced around the peripheral surface of the inner neck 110 proximate the second end 114 thereof. For example, even not shown, the flow deflecting member may comprises two holes 116 diametrically disposed on the peripheral surface of the inner neck 110 proximate the second end 114 thereof. As another example, not shown, the flow deflecting member may comprise four holes 116 disposed and spaced by 90 degree, i.e. evenly, around the peripheral surface of the inner neck 110 proximate the second end 114 thereof. At a particular situation, the adjoining portion between adjacent holes 116 may be simplified to be studs extending from the second end 114 of the inner neck 110, and the terminal of the inner neck 110 at the second end 114 may be regarded as an end cap supported by the four studs.

Figure 2:
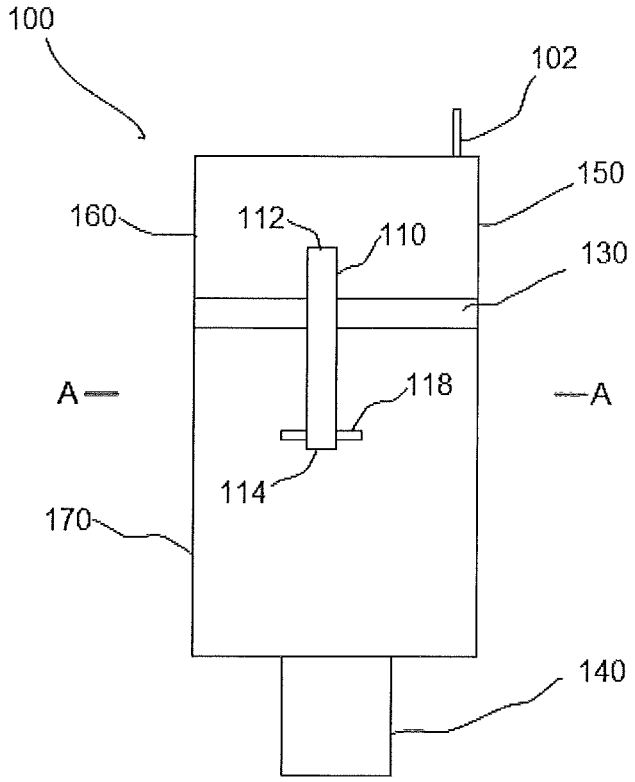
FIG. 2 is an elevation side view of a damper according to another example embodiment of the present invention.
Figure 3:
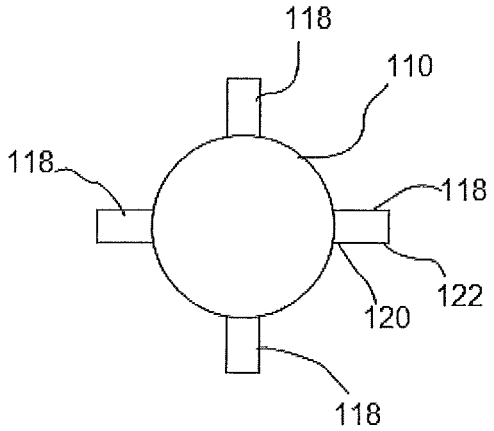
FIG. 3 is a section taken along the line A-A in FIG. 1 showing the arrangement of the guiding tubes.

FIG. 2 is an elevation side view of a damper 100 according to another example embodiment of the present invention. The damper shown in FIG. 2 is different from that shown in FIG. 1 in that the flow deflecting member takes different structures. The rest of the structure of the damper 100 as shown in FIG. 2 is similar to that of the damper 100 as shown in FIG. 1. As shown in FIG. 2, the flow deflecting member comprises at least one guiding tube 118 disposed at a first end 120 thereof on the peripheral surface proximate the second end 114 of the inner neck 110, wherein an outlet of the guiding tube 118, i.e. a second end 122, as shown in FIG. 3, directs at an angle 90 degree shifting from the longitudinal axis of the inner neck 110. That is, the outlet of the guiding tube 118 radially directs outwards. It should be understood by those skilled in the art that an angle shifting from the longitudinal axis of the inner neck, when it is mentioned herein, refers to the angle between the direction running from the second end 114 of the inner neck 110 to the first end 112 of the inner neck 110 and the direction to which the free end of the flow deflecting member faces. As an alternative of the flow deflecting member as shown in FIG. 2, the guiding tube 118 may be integrated at the first end 120 thereof with the inner neck 110 at the second end 114 thereof, in order to make a one-piece structure that may function the same as the flow deflecting member, even this is not shown in the drawings. In this case, the flow deflecting efficiency of the flow deflecting member may be improved due to stronger guiding capacity introduced by the tube shape structures. Hence, the flow field produced in the second cavity 170 will be further maintained stable.

FIG. 3 is a section taken along the line A-A in FIG. 1 showing the arrangement of the guiding tubes 118. According to a preferable embodiment of the present invention, the flow deflecting member may comprises four guiding tubes 118 evenly spaced around the peripheral surface of the inner neck 110, and disposed on the peripheral surface proximate the second end 114 of the inner neck 110. In this case, similar like the case shown in FIG. 1, the second end 114 of the inner neck 110 may be blinded or plugged in order to prevent fluid leakage therefrom.

Figure 4:
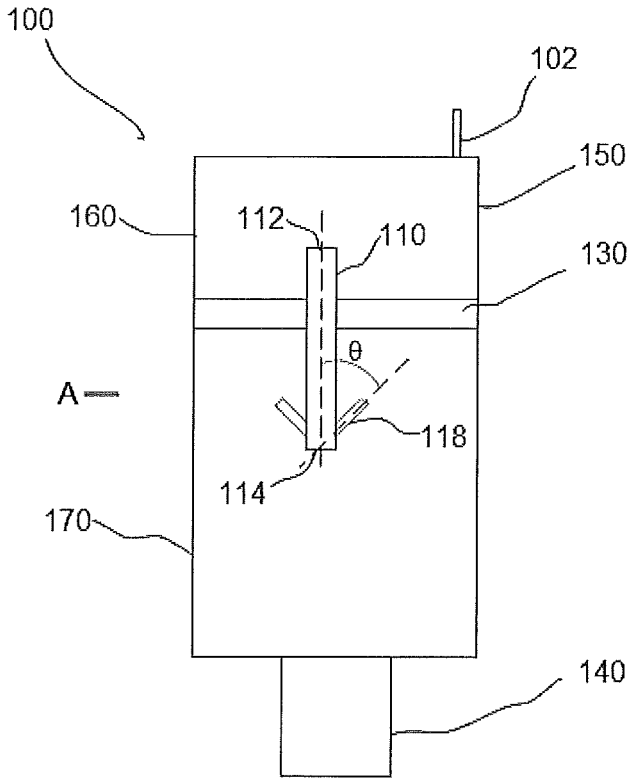
FIG. 4 is an elevation side view of a damper according to an alternative embodiment of the present invention.

FIG. 4 is an elevation side view of a damper 100 according to an alternative embodiment of the present invention. The damper 100 as shown in FIG. 4 is generally similar to the damper 100 as shown in FIG. 2. The damper 100 as shown in FIG. 4 differs in that the outlet of the guiding tube 118 direct at an angle of 45 degree shifting from the longitudinal axis of the inner neck 110, i.e. $\theta=45°$. In this case, similar like the case shown in FIG. 1, the second end 114 of the inner neck 110 may be blinded or plugged in order to prevent fluid leakage therefrom. According to a preferable embodiment of the present invention, not shown, the flow deflecting member may comprises two or four guiding tubes 118 evenly spaced around the peripheral surface of the inner neck 118, and disposed on the peripheral surface proximate the second end 114 of the inner neck 110.

Figure 5:
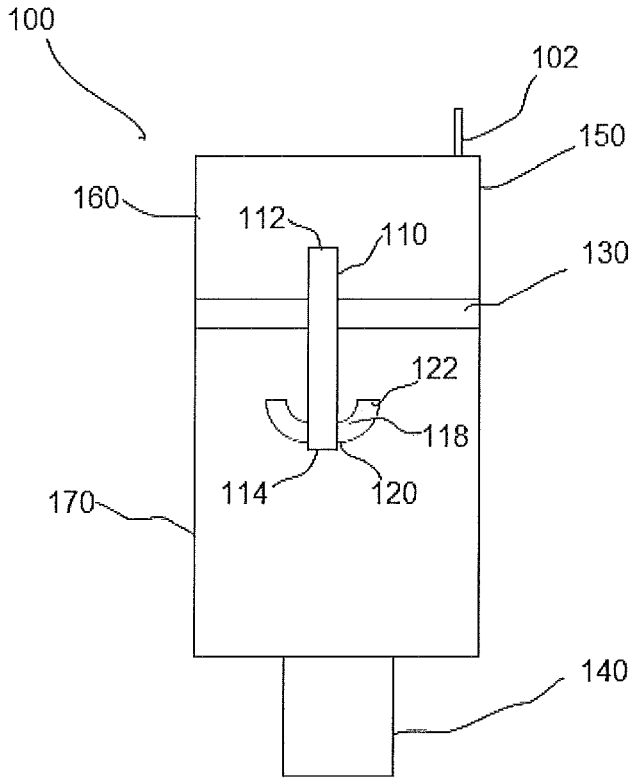
FIG. 5 is an elevation side view of a damper according to another alternative embodiment of the present invention.

FIG. 5 is an elevation side view of a damper 100 according to another alternative embodiment of the present invention. The damper 100 as shown in FIG. 5 is generally similar to the damper 100 as shown in FIG. 2. The damper 100 as shown in FIG. 5 differs in that the guiding tube 118 consists of a quarter of a ring tube with the first end 120 attached to the peripheral surface of the inner neck 100 proximate to the second end 114 thereof and the second end 122 directs to the spacer plate 130. i.e. reversely. In other words, the outlet of the guiding tube 118 directs at the angle of 0 degree shifting from the longitudinal axis of the inner neck 110. According to a preferable embodiment of the present invention, not shown, the flow deflecting member may comprises two or four guiding tubes 118 evenly spaced around the peripheral surface of the inner neck 118, and disposed on the peripheral surface proximate the second end 114 of the inner neck 110. In this case, similar like the case shown in FIG. 1, the second end 114 of the inner neck 110 may be blinded or plugged in order to prevent fluid leakage therefrom.

As a simple alternative embodiment, not shown, the guiding tube 118 as shown in FIG. 5 may integrate at the first end 120 thereof with the inner neck at the second end 114 thereof. This structure may even applies to the case that the flow deflecting member comprises a plurality of guiding members 118 as shown in FIG. 5.

It should be noticed by those skilled in the art that, where necessary, the outlet of the guiding tube 118 may be determined in the range from 0 to 90 degrees shifting from the longitudinal axis of the inner neck 110, in order to adjust the flow field produced therefrom.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A damper for reducing pulsations in a gas turbine, the damper comprising:

an enclosure;

a spacer plate disposed in the enclosure to separate the enclosure into a first cavity and a second cavity;

a main neck extending from the second cavity of the enclosure;

an inner neck with a first end and a second end, the inner neck extending through the spacer plate to interconnect the first cavity and the second cavity, wherein the first end of the inner neck remains in the first cavity and the second end remains in the second cavity; and a flow deflecting member is disposed proximate the second end of the inner neck to deflect a flow passing through the inner neck wherein the flow deflecting member comprises at least one hole disposed on a peripheral surface of the inner neck proximate the second end thereof, and the second end of the inner neck is blinded or plugged.

2. The damper according to claim 1, wherein the at least one hole comprises at least two holes evenly disposed around the peripheral surface of the inner neck.

3. A damper for reducing pulsations in a gas turbine, the damper comprising:

an enclosure;

a spacer plate disposed in the enclosure to separate the enclosure into a first cavity and a second cavity;

a main neck extending from the second cavity of the enclosure;

an inner neck with a first end and a second end, the inner neck extending through the spacer plate to interconnect the first cavity and the second cavity, wherein the first end of the inner neck remains in the first cavity and the second end remains in the second cavity; and a flow deflecting member is disposed proximate the second end of the inner neck to deflect a flow passing through the inner neck, wherein the flow deflecting member comprises at least two guiding tubes disposed proximate the second end of the inner neck, each outlet of the guiding tubes is configured to direct a flow at an angle shifted from a longitudinal axis of the inner neck and the at least two guiding tubes are evenly disposed around a peripheral surface of the inner neck.

4. The damper according to claim 3, wherein each outlet of the guiding tubes is configured to direct the flow at the angle ranging from 0 to 90 degrees shifted from the longitudinal axis of the inner neck.

* * * * *